US009885096B2

(12) United States Patent
Barsa

(10) Patent No.: US 9,885,096 B2
(45) **Date of Patent: *Feb. 6, 2018**

(54) METHOD AND APPARATUS FOR HIGH TEMPERATURE PRODUCTION OF METALS

(71) Applicant: John Joseph Barsa, New York, NY (US)

(72) Inventor: John Joseph Barsa, New York, NY (US)

( * ) Notice: Subject to any disclaimer, the term of this patent is extended or adjusted under 35 U.S.C. 154(b) by 558 days.

This patent is subject to a terminal disclaimer.

(21) Appl. No.: 14/472,718

(22) Filed: Aug. 29, 2014

(65) Prior Publication Data

US 2015/0040728 A1 Feb. 12, 2015

Related U.S. Application Data

(63) Continuation-in-part of application No. 13/385,526, filed on Feb. 24, 2012, now Pat. No. 9,039,805.

(51) Int. Cl.

| | |
|---|---|
| ***C22B 5/02*** | (2006.01) |
| ***C22B 19/20*** | (2006.01) |
| ***C22B 26/22*** | (2006.01) |
| ***C22B 5/04*** | (2006.01) |
| ***C22B 5/12*** | (2006.01) |
| ***C22B 5/16*** | (2006.01) |
| ***C22B 34/32*** | (2006.01) |
| ***C22B 47/00*** | (2006.01) |
| ***C22B 5/10*** | (2006.01) |

(52) U.S. Cl.

CPC ..... *C22B 5/12* (2013.01); *C22B 5/04* (2013.01); *C22B 5/10* (2013.01); *C22B 5/16* (2013.01); *C22B 19/20* (2013.01); *C22B 34/32* (2013.01); *C22B 47/00* (2013.01)

(58) Field of Classification Search

None

See application file for complete search history.

(56) References Cited

U.S. PATENT DOCUMENTS

| | | | | |
|---|---|---|---|---|
| 4,290,804 | A * | 9/1981 | Avery | C22B 26/22 75/10.33 |
| 9,039,805 | B2 * | 5/2015 | Barsa | C22B 5/04 75/599 |
| 2010/0288649 | A1 * | 11/2010 | Pal | C22B 5/04 205/763 |

OTHER PUBLICATIONS

Yang et al. (ISIJ International, 2001, vol. 41, p. 945-954).*

* cited by examiner

*Primary Examiner* — Xiaowei Su

(74) *Attorney, Agent, or Firm* — H. Jay Spiegel

(57) ABSTRACT

Carbothermic reduction of magnesium oxide at approximately 2200 degrees Kelvin yields a high temperature mixture of magnesium vapors and carbon monoxide gas. Previous processes have sought to cool or alter the mixture to cause the yield of pure magnesium, which is then used in subsequent processes for its reducing properties. The present invention takes advantage of the stability and inertness of carbon monoxide at elevated temperatures enabling the magnesium vapor/carbon monoxide gas mixture from the carbothermic process to be used directly for the production of other metals at high temperatures. For example, Chromium oxide or chloride, manganese oxide or chloride, zinc oxide or chloride or sulfide, and several other metal compounds can be reduced by the magnesium vapor/carbon monoxide gas mixture at temperatures high enough to prevent the gas mixture from back-reacting to magnesium oxide and carbon.

17 Claims, 6 Drawing Sheets

METHOD AND APPARATUS FOR HIGH TEMPERATURE PRODUCTION OF METALS

FIELD OF THE INVENTION

The present invention is directed to a method and apparatus for use in the production of metals from their oxides, halides, hydroxides, sulfides, or polyatomic forms by simple reduction at high temperature in the presence of a gaseous mixture of magnesium and carbon monoxide, where the gaseous mixture is obtained by carbothermic reduction of magnesium oxide without an intervening step or process of separating the resulting magnesium.

BACKGROUND OF THE INVENTION

This application is a continuation-in-part of application Ser. No. 13/385,526 filed Feb. 24, 2012, and which was published on Aug. 29, 2013 as published application no. US 2013/0220077-A1, and which was issued on May 26, 2015 as U.S. Pat. No. 9,039,805. The reducing property of magnesium vapor for purifying metals from metal oxides, sulfides and the like is well known as represented by Hivert, et al., U.S. Pat. No. 2,881,067 which teaches the production of powder metals from oxides by reaction with magnesium vapor produced by heating elemental magnesium.

Similarly, Shekhter, et al., U.S. Pat. No. 6,171,363 and U.S. Pat. No. 6,558,447, employ elemental magnesium mixed with tantalum and niobium oxides and directly heated to about 1000° C., thereby generating gaseous magnesium in direct contact with the metal oxides to reduce the oxides to pure metal.

The problem with the prior art processes for reduction of metal oxides, halides and other metal compounds by magnesium vapor is in obtaining the elemental magnesium for heating to provide magnesium reduction. The cost of magnesium is quite high, varying back and forth in recent years in the range between $0.60 and $ 1.20 per pound. Since the cost of the reagent is usually multiplied by 4 to 6 times to estimate the cost of the final product, this means that magnesium as a reducing agent can only be used for expensive specialty products.

Since the early part of the 1900s, Hansgirg and others have demonstrated that inexpensive carbon, varying between $0.01 to $0.04 per pound, can be used to liberate magnesium vapors from magnesium oxide at high temperatures to produce magnesium and carbon monoxide. Magnesium oxide is reacted with carbon, usually at or above 2200 degrees K. Carbon has an increasing affinity for oxygen at such elevated temperatures, while magnesium's bond with oxygen becomes less stable with increasing temperature. The result of this carbothermic reduction of magnesium oxide is production of a mixture of magnesium gas and carbon monoxide gas, hoping to yield elemental magnesium for other uses.

However, problems with the carbothermic process to yield magnesium metal arise from magnesium's greater affinity for oxygen when the mixture cools, producing a back-reaction to magnesium oxide and carbon. Attempts to rapidly cool the mixture to minimize the opportunity for back-reaction and produce magnesium metal have a tendency to yield magnesium powder which is hazardous in large-scale environments, as noted by Diaz, et al. Because of the danger of industrial accidents, the carbon-based method to directly produce magnesium metal was abandoned in the late 1940's.

Other inventors who still sought to use the inexpensive carbon method to reduce magnesium devised complicated, expensive methods to separate magnesium from the carbon monoxide so that the back-reaction to magnesium oxide and carbon did not occur. Such separation processes are represented by Mod, et al., U.S. Pat. No. 3,560,198, in which magnesium and carbon monoxide vapors produced by typical carbothermic reduction of MgO ores are passed through a bed of metal carbides at temperatures of 1500 to about 1850° C. At those temperatures, the carbon monoxide reacts with the metal carbides to form metal oxides and carbon. Mod, et al., teach that the magnesium vapors do not react with either the carbides or the resulting oxides and that the elemental magnesium is separated out for recovery. Also, Diaz, et al., U.S. Pat. No. 5,782,952, provides a continuous process for the production of elemental magnesium from magnesium oxide and a light hydrocarbon gas reacted at a temperature of about 1400° C. or greater. The resulting product stream is continuously quenched to separate elemental magnesium for use elsewhere. Other attempts used to refine the carbothermic method to produce magnesium have included rapid quenching with hydrocarbons, liquid magnesium, inert gases, and the use of supersonic nozzles to accelerate the quenching process.

Avery, U.S. Pat. No. 4,290,804, used a complex method to separate the magnesium from the carbon monoxide, and Pal, U.S. Published Application No. US 2010/0288649 A1, devised a complicated solid membrane technology to produce magnesium for further use. Unfortunately, each of these methods produce the reducing action of magnesium at the very high cost.

None of these prior processes teaches the direct utility of use of the gaseous magnesium and carbon monoxide mixture produced by carbothermic reduction of magnesium oxide with carbon as a reducing agent for production of metals from metal oxides, hydroxides, sulfides or polyatomic compounds, thereby avoiding the necessity of first separating the elemental magnesium and preparing it for use as a source of magnesium vapor.

The present invention takes advantage of the scientific facts, some known since the 1940's but not used by any other investigators, of the stability of carbon monoxide at the carbothermic reduction temperatures, such that the high-temperature mixture can be used to reduce raw materials and recover other non-magnesium substances as discovered by applicant. Carbon monoxide at approximately 2200 degrees K is stable and can be considered an inert gas in a carbothermic mixture, so that the strong reducing nature of magnesium vapors can be employed with other substances needing reduction. Examples of such substances which applicant found can be reduced using the present method include chromium oxide, halides (chlorides, fluorides, bromides, iodides), polyatomic chromium compounds containing oxygen, manganese oxide, halides, polyatomic manganese compounds, zinc oxide, zinc halides, hydroxide, sulfide, or polyatomic zinc compounds containing oxygen or sulfur.

The present invention takes advantage of the stability of carbon monoxide at carbothermic temperatures such that the high temperature gaseous mixture of magnesium and carbon monoxide can be used to reduce such oxides, halides (chlorides, fluorides, bromides, iodides), hydroxides, sulfides and polyatomic compounds to greater purity than prior methods.

For example, most chromium is currently made by the carbon reduction of chromium III oxide, or $Cr_2O_3$.

$$Cr_2O_3(c)+3C(c) \text{ at } 2200^\circ \text{ K yields } Cr(l)+3CO$$

The Gibbs Free Energy values for this reaction are −562 KJ/mol+0 - - - - - - - - - - - - - - - - - 0+−908 KJ/mol. A negative Gibbs Free Energy means that reduction of metal oxides to the metallic state is favorable.

Unfortunately, in actual practice, small amounts of free accumulated carbon react with the chromium to produce some contaminating chromium carbide, $Cr_7C_3$(c), which is quite stable at −221 KJ/mol. This means that very-low carbon chromium is usually made by reduction with aluminum, the aluminothermic reduction, or by electrolytic methods such as electrolytic deposition from a chromium-alum electrolyte made from high carbon ferrochromium, or, in the recent FFC process, electrolyzed at 1200° K using $CaCl_2$ liquid, producing a sponge metal. In the latter process, the metal sponge must be heated to 2200° K to melt the chromium into ingots anyway. Because of the materials required and added steps, these are more expensive processes than this proposed invention.

Similarly, manganese is currently produced carbothermically, using carbon granules interacting at high temperature with manganese II oxide, MnO, the heat decomposition product of $Mn_3O_4$. This method, similar to the chromium situation discussed above, is complicated by the formation of manganese carbide impurities. Additional reaction with MnO is usually done to try to eliminate as much of the carbon from the manganese as possible, but some impurities remain. Another method to produce manganese is by electrolysis of manganese sulfate solutions which raises environmental problems.

Zinc has been commonly produced by roasting the main ore, ZnS, in air to form ZnO and $SO_2$. The ZnO is then carbothermically reduced to Zn, CO, and $CO_2$ gases. However, this process presents serious problems with air pollution and the back-reaction between the $CO_2$ and Zn. Most zinc is now made electrolytically where ZnS is oxidized to $ZnSO_4$, either by treating roast-produced ZnO with sulfuric acid (the acid being generated by the oxidation of the ZnS), or, to avoid the pollution-plagued roasting, the ZnS is directly treated with sulfuric acid and oxygen under pressure, with deposited free sulfur used to generate the sulfuric acid. The $ZnSO_4$ is then electrolyzed in an aqueous environment.

SUMMARY OF THE INVENTION

It is an object of the present invention to provide a method for reduction of metal oxides, chlorides, fluorides, bromides, iodides and other polyatomic compounds which takes advantage of the known reductive property of magnesium in a simple and efficient manner.

It is a further object to provide a method for reduction of metal compounds using the direct application of magnesium vapor generated by carbothermic reduction of magnesium oxide without having to first separate magnesium and carbon monoxide.

It is a still further object to provide a method whereby the magnesium compounds produced upon reduction of other metal compounds with magnesium vapor can be sold. If the compound is MgO, it can be recycled for further use in carbothermic reduction to produce magnesium vapor.

The present invention seeks to overcome problems associated with prior carbothermic processes and to provide a method for direct reduction of metal compounds to metals of higher purity without inclusions requiring further refining steps and without pollution plagued preliminary treatments. As such, the present invention utilizes the reducing nature of magnesium vapors obtained at high temperatures by carbothermic reduction of magnesium oxide and carbon, but without the added step of first separating and recovering magnesium for subsequent heating as in prior art methods.

In the present invention, carbothermic reduction of MgO and carbon occurs in a first chamber, producing a gaseous mixture of Mg and CO which is maintained at carbothermic temperatures as it passes through a filter to remove any sublimed carbon fragments or dust. From the filter, the gaseous mixture passes into a second chamber, maintained at carbothermic temperatures or a temperature that is at least sufficient to prevent the back reaction to magnesium oxide and carbon, in which compounds to be reduced are maintained. Preferably the compounds to be reduced by the gaseous magnesium are either themselves gaseous, or liquid, or at least small solid forms which can be efficiently reacted with the magnesium vapors. Reduction of the target compounds produces a pure metal which is easily and readily recoverable, magnesium compounds which can be sold or recycled to the first chamber, and carbon monoxide gas which itself can be burned for energy needs.

In a preferred embodiment, in a first inert chamber magnesium oxide and carbon are heated to produce a gaseous mixture of magnesium and carbon monoxide in accordance with the following formula:

$$3MgO(c)+3C(c) \text{ at 2200 degrees K yields } 3Mg(g)+3CO(g)$$

This gaseous mixture is fed through a high temperature MgO zone to filter out any carbon other than that present as CO gas. The purified mixture is directed into another chamber wherein target metal oxides, halides, polyatomic oxides, or sulfides of metals are kept at the same temperature as the first chamber or temperatures at least high enough to prevent the back-reaction of the Mg/CO mixture. The magnesium gas combines with the desired target metal's oxygen, halide or sulfur atoms, leaving the reduced desired metal. The desired reduced metal is then collected, the CO gas is separated and the resulting magnesium compounds can be used.

Thus, the present invention provides a method for the reduction of metal oxides, halides (prepared in an adjoining chamber by carbon-mediated chlorination, bromination, iodination or fluoridation), hydroxides, sulfides or polyatomic compounds thereof by direct usage of the products of carbothermic reduction of magnesium oxide, comprising conducting carbothermic reduction of magnesium oxide in the presence of carbon at an elevated temperature of from 1500 to 2600 degrees Kelvin, producing a mixture of magnesium vapor and carbon monoxide gas and contacting the desired metal's compounds with that mixture of vapor and gas mixture at the elevated temperature, whereby the mixture of magnesium vapor and carbon monoxide gas is prevented from undergoing back-reaction to magnesium oxide and carbon, and the magnesium vapor effects reduction of desired metal's compounds with that mixture to metallic forms. Furthermore, in cases where magnesium halides are formed, these may be sold. Where MgO is formed, it may be recovered and recycled back to the carbothermic reduction step.

The present invention particularly provides a method for production of metals from their compounds using a carbothermically produced mixture of magnesium vapor and carbon monoxide gas to reduce the desired target metal's compounds and comprising maintaining all the reactants at temperatures preventing the back reaction to MgO and carbon, producing the desired metal, and finding uses for the resulting magnesium entities. By maintaining the temperature, a back-reaction of magnesium vapor and carbon monoxide gas to magnesium oxide or halide and carbon before reduction of the metal oxides is prevented.

The present invention still further provides a method for production of metals from their compounds comprising, providing a reactor body comprising first and second reaction chambers, a heating means capable of heating the reactor to carbothermic temperatures and maintaining those temperatures to prevent back reaction to MgO and carbon, and filtering between chambers to ensure purity. The first chamber is charged with a mixture of solid magnesium oxide and solid carbon. Its gaseous products are fed into a chamber with the desired metal's compounds, such as halides produced in an adjoining chamber by carbon-mediated halogenation, or oxides, or hydroxides, or sulfides or polyatomic compounds. The reactor is heated to carbothermic temperatures, with the resultant mixture of magnesium vapor and CO led into another chamber where the mixture reduces the desired metal's compounds to the desired metal, while the magnesium vapor is changed to its halide, sulfide or oxide form.

DESCRIPTION OF THE INVENTION AND PREFERRED EMBODIMENTS

Figure 1:
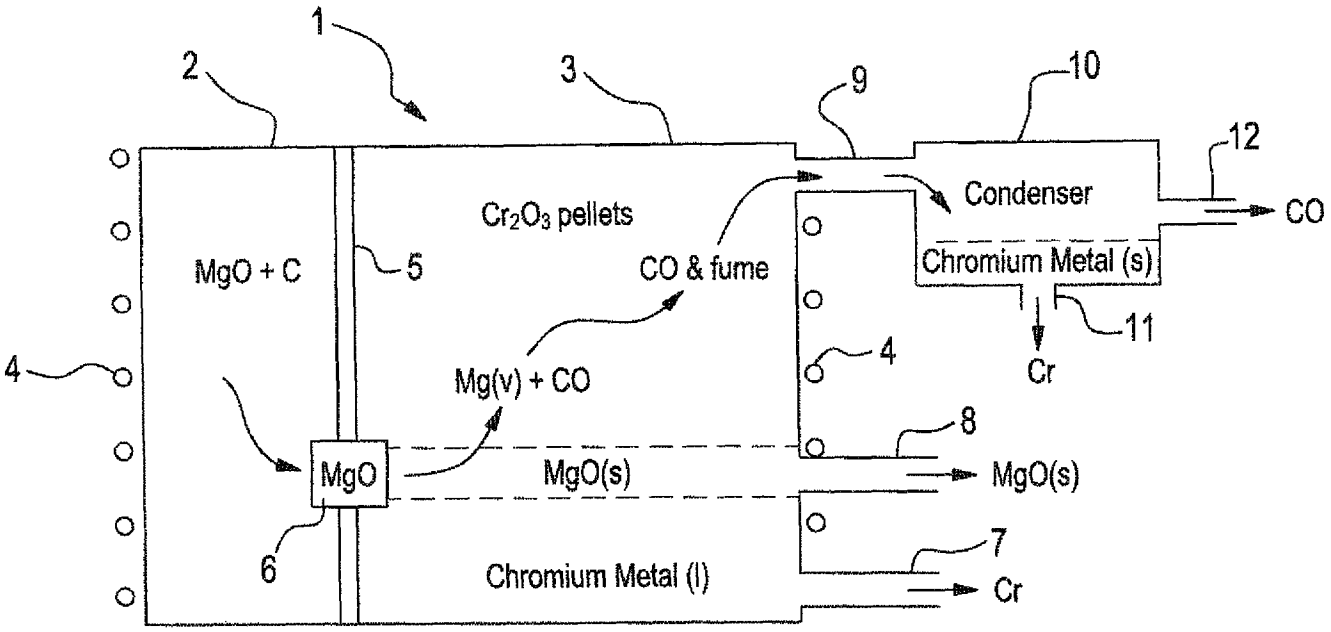
FIG. 1 is a schematic diagram illustrating a batch embodiment of the present invention.

Magnesium oxide, MgO, can be made in an assortment of ways well known to those skilled in the art. These methods include decomposing $MgCO_3$ with heat, decomposing $Mg(OH)_2$ with heat, treating dolomite ($CaCO_3a.MgCO_3b$) with heat to form calcined dolomite (CaOa.MgOb) which is then treated with water to separate the magnesium oxide, treating $MgCl_2$ with steam, etc.

Carbon, from any of such sources as solid petroleum coke, solid purified coal, solid charcoal, or gaseous hydrocarbon compounds which decompose at temperatures lower than the carbothermic temperatures are mixed with the MgO in a first reaction zone. The first reaction zone chamber is preferably made of any refractory material constituted by materials inert to the reactants involved in this described invention, for example graphite. Other materials meeting these refractory and inert qualities include 1) refractory noble metals, 2) any structurally strong, refractory material lined with an inert refractory substance such as graphite, lime, passive metal, or other inert fused oxide, nitride, or carbide. Although graphite may be used to construct the first reaction zone chamber, it is noted that non-carbon refractory materials should be used in all other reaction zones to prevent contamination of product. Graphite or carbide materials can be used in these other reaction zones only if they are thoroughly lined with non-carbon, inert, refractory materials to prevent exposed carbon from contaminating the product.

The MgO/C ratio in the starting mixture is preferably that which meets the stoichiometric needs of the reaction.

The MgO/C mixture is heated in a carbothermic reaction zone to between 1500 and 2600 degrees Kelvin, preferably 2000 to 2400 degrees Kelvin, but most preferably to about 2200 degrees Kelvin to enable the carbothermic reduction of MgO to proceed and prevent back-reaction of the resulting magnesium and carbon monoxide. Heat may be provided by any means commonly known to be used in high temperature furnaces including electrical resistance, electrical induction, combustion of fuels and the like. The carbothermic reaction yields a mixture of Mg gas and CO gas. If hydrocarbon gases are used as the carbon source, the hydrocarbons are first heat-decomposed into C atoms and $H_2$ gas before being mixed with heated MgO dust.

The gaseous Mg/CO mixture from the first reaction chamber is directed through a filtering supply of hot MgO to ensure no carbon species other than CO gas is being swept along. The gaseous Mg/CO mixture is then directed into a second chamber to intermingle with the oxide or sulfide or halide compounds of the desired metal product. The second chamber and its contents are maintained at carbothermic temperature or at a temperature at least high enough to prevent back-reaction of the Mg/CO mixture to MgO/C. In addition, filter chamber, second chamber and any subsequent chambers, conduits, etc., are preferably made from or thoroughly lined with any non-carbon materials which are inert to the reactants involved. Because the filter through which the Mg/CO mixture passes removes any errant forms of carbon other than CO gas, exposed carbon materials should be avoided downstream of the filter to prevent contamination of the metals being produced. Suitable materials would include 1) refractory noble metals, 2) any structurally strong refractory material which is thoroughly lined with an inert refractory substance such as magnesia, lime or other inert metal or fused oxide or nitride. Carbon materials, such as graphite, may be used only if thoroughly lined with an inert refractory to prevent exposure of the carbon material to the reactants.

The magnesium component of the gaseous mixture reduces the compound of the desired metal which is then collected from the chamber. If the desired metal is a liquid or solid, the gases can be vented and the desired metal separated from the magnesium oxide or sulfide or halide. If the desired metal is gaseous, it can be distilled in a distillation chamber from the CO and any other gas. The magnesium compound solids can be recovered and recycled to the MgO feed reactant.

The boundary between the first chamber holding the MgO and C and the second chamber holding the oxide or sulfide pellets to be reduced includes a filter holding MgO at the same carbothermic temperature and through which the gaseous Mg/CO mixture passes to filter out any carbon not bound as CO gas. That filter may comprise all or part of the boundary.

In those embodiments in which the resulting metal is in gaseous form and must be condensed for recovery, for example, manganese and zinc and, to a lesser extent, chromium, the gases including the metal are directed to a third chamber for such condensation.

FIG. 1 provides a schematic diagram of the present method and a basic apparatus for carrying out the method.

Reactor 1 is divided into first and second chambers 2, 3. Reactor 1 is provided with heat from electrical heaters 4, although other heat sources suitable for providing the required carbothermic temperatures may be used. Chambers 2 and 3 are separated by boundary wall 5 in which is disposed filter 6. Filter 6 provides access between first chamber 2 and second chamber 3 for gaseous Mg/CO mixture generated in first chamber 2. Alternatively, filter 6 may comprise all or most of the extent of boundary wall 5. Filter 6 comprises MgO in a form to permit passage of the gaseous Mg/CO mixture and is maintained at or about carbothermic temperatures.

First chamber 2 is charged with magnesium oxide and carbon in stoichiometric amounts relative to the overall reaction and is heated to carbothermic temperatures producing gaseous Mg/CO which passes through filter 6 whereby any unreacted carbon is removed from the gaseous stream.

Second chamber 3 is charged with oxides or sulfides or halides of metals to be purified by the method, the oxides or sulfides or halides being in particulate or pellet form. Within second chamber 3, gaseous magnesium reacts with the metal oxide or sulfide or halide at the elevated temperatures maintained in second chamber 3 reducing the metal oxide or sulfide or halide to the pure metal and forming magnesium oxide or magnesium sulfide or magnesium chloride, for example. In the particular example shown in FIG. 1, $Cr_2O_3$ is reduced to produce liquid chromium metal which is recovered from the bottom of second chamber 3 at conduit 7. The resulting solid magnesium oxide may also be recovered from second chamber 3 at conduit 8.

Still gaseous carbon monoxide together with any residual metal vapor is drawn off at 9 from the upper end of second chamber 3 and passes to condenser 10 where such residual metal is separated as liquid or solid 11 and gaseous carbon monoxide is drawn off for reduction and reuse 12.

Figure 2:
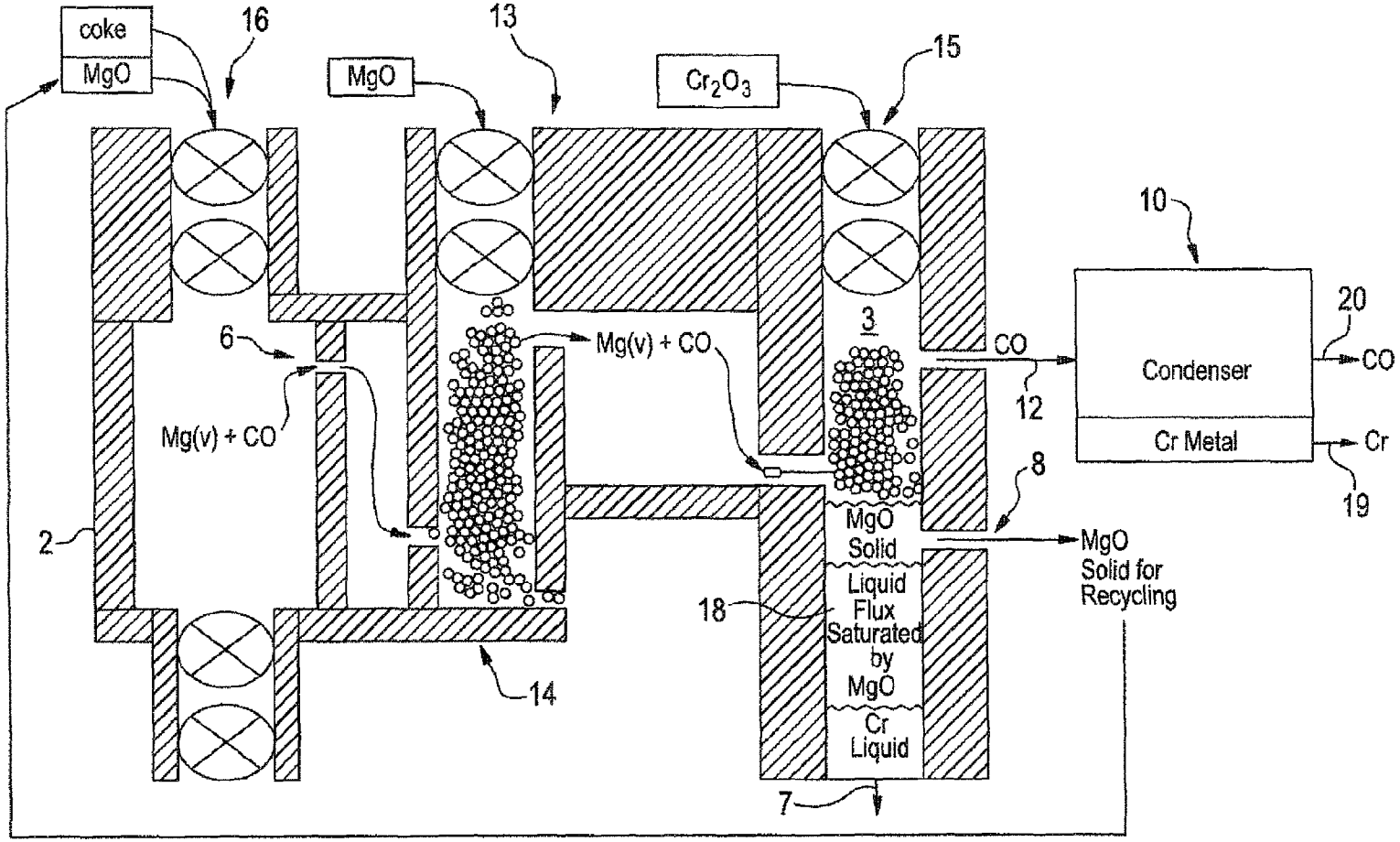
FIG. 2 is a schematic diagram illustrating a continuous embodiment of the present invention producing chromium metal.

The method and apparatus may operate in batch form, as shown in FIG. 1, with reactor 1 being charged, the reactions permitted to proceed to completion and reactor 1 then emptied for recovery of product and recharging. Alternatively, FIG. 2 illustrates a continuous process 13 incorporating first chamber 2 for carbothermic reduction of magnesium oxide to a mixture of magnesium vapor and carbon monoxide which passes through a MgO-fed filter 14 to a bed of particulate $Cr_2O_3$ which is continually introduced into second reaction chamber 3 by feed mechanism 15. A similar feed mechanism 16 supplies MgO and carbon to chamber 2. Such feed mechanisms are well known in the art. Following reduction of the $Cr_2O_3$, the resulting chromium liquid settles at the bottom of the second reaction chamber 3 and is collected at the outlet 7. Solid magnesium oxide floats on top of the liquid chromium and is recovered at 8 for recycling to feed mechanism 16. A flux 18 by virtue of its being lighter than the liquid chromium and heavier than the solid MgO may be used to further separate any adherent chromium from the magnesium oxide. To a partial extent, some chromium will be in vapor form and mixed with the carbon monoxide. This will exit the second reaction chamber 3 by vent 12 directed to condenser 10. Liquid chromium will be drawn off at the bottom of the condenser 19 and carbon monoxide is drawn off at 20 for use. The same continuous process may be used employing, for example, chromium chloride.

The following examples are representative of the present invention.

Example 1

In the method schematically illustrated in FIGS. 1 and 2, very-low carbon chromium metal is produced. In the process of this invention, gaseous Mg/CO mixture is produced in first chamber 2 following the formula:

$$3MgO(c)+3C \text{ at } 2200^\circ \text{ K yields } 3Mg(g)+3CO(g).$$

This gaseous product, without any free C, is passed over $Cr_2O_3$ in second chamber 3, for reduction of $Cr_2O_3$ in accordance with:

$$3Mg(g)+3CO(g)+Cr_2O_3(c) \text{ at } 2200^\circ \text{ K yields } 3MgO(c)+2Cr(l)+3CO(g)$$

The Gibbs Free Energy values for this reaction are
0+−908 KJ/mol+−562 KJ/mol - - - - - - - - - - yields −839 KJ/mol+0+−908 KJ/mol
Or, by viewing the gaseous CO as an inert gas at 2200° K, −562 KJ/mol - - - - - - - - - - - yields −839 KJ/mol (Gibbs Free Energies).
The overall negative Gibbs Free Energy favors reduction of $Cr_2O_3$ to chromium so that the chromium liquid is tapped out from below. The magnesium oxide crystals can be periodically cleaned of any adherent chromium by vacuum removal of the chromium because its vapor pressure is substantially higher than the magnesium oxide crystals. The magnesium oxide can then be recycled. An alternate embodiment of this process may use a flux to better separate adherent chromium from the magnesium oxide. The CO is vented and used for any purpose including heat recovery for the process through a pre-heater or use in another synthesis.

The usual source of the $Cr_2O_3$ starts with purified chromite, $FeCrO_4$. The present invention can also be used to reduce $FeCrO_4$ by the purified Mg/CO gas in second chamber 3, where the reduced product is very-low carbon ferrochromium, a useful material employed in the production of numerous alloys such as stainless steel. The present invention can further be used to reduce numerous chromium compounds, producing mixed metals or alloys, of any starting material where chromium atoms and oxygen or sulfide atoms exist.

In addition, sodium dichromate $Na_2Cr_2O_7$ can be used as the chromium compound in second chamber 3. Sodium dichromate is made by treating chromite with molten NaOH and $O_2$ to convert the Cr III to $CrO_4^{(-2)}$. The melt is then dissolved in water and sodium dichromate is precipitated. In the present invention, the $Na_2Cr_2O_7$ is reduced by the gaseous Mg/CO mixture, producing very-low carbon chromium, with vented gases being CO and Na gas which can be collected and separated. The MgO is recycled.

The present invention can be applied to alternate sources of chromium obtained from the ores listed in Table 1.

TABLE 1

Terrestrial Minerals Containing Chromium as a Major Constituent:

| Name | General formula | Wt % Cr |
|---|---|---|
| Barbertonite | $Mg_6Cr_2(CO_3)(OH)_{16}\bullet 4H_2O$ | 16 |
| Bentorite | $Ca_6(Cr,Al)_2(SO_4)_3(OH)_{12}\bullet 26H_2O$ | 5 |
| Bracewellite[b] | CrO(OH) | 61 |
| Brezinaite | $Cr_3S_4$ | 47-50 |
| Carlsbursite | CrN | 79 |
| Caswellsilverite | $NaCrS_2$ | 37 |
| Chromian diopside | $Ca(Mg,Fe,Cr)Si_2O_6$ | 0.1-8 |
| Chromian geikielite | $(Mg,Fe^{2+},Cr,Fe^{3+})(Ti,Cr,Fe^{3+})O_3$ | 0.5-8.5 |
| Chromian garnet | $(Cr,Mg)_3(Al,Cr)_2(SiO_4)_3$ | 0.1-13 |
| Chromite | $(Mg,Fe^{2+})(Cr,Al,Fe^{3+})_2O_4$ | 10-54 |
| Chromatite | $CaCrO_4$ | 33 |

TABLE 1-continued

| Terrestrial Minerals Containing Chromium as a Major Constituent: | | |
|---|---|---|
| Name | General formula | Wt % Cr |
| Chromian clinochlore | $(Mg,Fe^{2+})(Al,Cr)_2(Al_2,Si_2)O_{10}(OH)_8$ | 0.5-12 |
| Cochromite | $(Co,Ni,Fe^{2+})(Al,Cr)_2O_4$ | 34-37 |
| Crocoite | $PbCrO_4$ | 16 |
| Daubreelite | $Fe^{2+}Cr_2S_4$ | 36 |
| Deanesmithite | $Hg_2^{1+}Hg_3^{2+}Cr^{6+}O_5S_2$ | 4.3 |
| Dietzeite | $Ca_2(IO_3)_2(CrO_4)$ | 10 |
| Donathite | $(Mg,Fe^{2+})(Cr,Fe^{3+})_2O_4$ | 28-30 |
| Edoylerite | $Hg_3^{2+}Cr^{6+}O_4S_2$ | 6.6 |
| Embreyite | $Pb_5(CrO_4)(PO_4)_2 \bullet H_2O$ | 7 |
| Eskolaite | $Cr_2O_3$ | 44-68 |
| Fornacite | $(Pb,Cu)_3[(Cr,As)O_4]_2(OH)$ | 6 |
| Fuchsite | $K(Al,Cr)_2(AlSi_3)O_{10}(OH)_2$ | 0.5-6 |
| Georgeerick-senite | $Na_6CaMg(IO_3)_6(CrO_4)_2(H_2O)_{12}$ | 5 |
| Grimaldiite[b] | $CrO(OH)$ | 61 |
| Guyanaite[b] | $CrO(OH)$ | 61 |
| Heideite | $(Fe,Cr)_{1+x}(Ti,Fe)_2S_4$ | 0.1-18 |
| Hemihedrite | $Pb_{10}Zn(CrO_4)_6(SiO_4)_2F_2$ | 13-14 |
| Iranite | $Pb_{10}Cu(CrO_4)_6(SiO_4)_2(F,OH)_2$ | 10 |
| Knorringite | $Mg_3Cr_2(SiO_4)_3$ | 12-23 |
| Krinovite | $NaMg_2CrSi_3O_{10}$ | 14 |
| Lopezite | $K_2Cr_2O_7$ | 35 |
| Loveringite | $(Ca,Ce)(Ti,Fe^{3+},Cr,Mg)_{31}O_{38}$ | 0.5-10 |
| Macquartite | $Pb_3Cu(CrO_4)SiO_3(OH)_4 \bullet 2H_2O$ | 6 |
| Mangano-chromite | $(Mn,Fe^{2+})(Cr,V)_2O_4$ | 41-62 |
| Mariposite | $K(Al,Cr)_2(Si_{3+x}Al_{1-y})O_{10}(OH)_2$ | 0.5-6 |
| McConnellite | $CuCrO_2$ | 35 |
| Mountkeithite | $(Mg,Ni)_{11}(Fe^{3+},Cr,Ni)_3(OH)_{24}(CO_3,SO_4)_{3.5}(Mg,Ni)_2(SO_4)_2 \bullet 11H_2O$ | 2.2-6 |
| Nichromite | $(Ni,CoFe^{2+})(Cr,Fe^{3+},Al)_2O_{-4}$ | 31-37 |
| Phoenicochroite | $Pb_2(CrO_4)O$ | 8-10 |
| Redingtonite | $Fe^{2+},Mg,Ni)(Cr,Al)_2(SO_4)_4 \bullet 22H_2O$ | 0.5-3 |
| Redledgeite | $Mg_4Cr_6Ti_{23}Si_2O_{61}(OH)_4$ | 11 |
| Rilandite | $(Cr,Al)_6SiO_{11} \bullet 5H_2O$ | 33 |
| Santanaite | $9PbO \bullet 2PbO_2 \bullet CrO_3$ | 2 |
| Schreyerite | $(V,Cr,Al)_2Ti_3O_9$ | 0.7-3.6 |
| Shuiskite | $Ca_2(Mg,Al,Fe)(Cr,Al)_2[(Si,Al)O_4](Si_2O_7)(OH)_2 \bullet H_2O$ | 10-17 |
| Stichtite | $Mg_6Cr_2(CO_3)(OH)_{16} \bullet 4H_2O$ | 6-19 |
| Tarapacaite | $K_2CrO_4$ | 27 |
| Ureyite | $NaCrSi_2O_6$ | 23 |
| Uvarovite | $Ca_3Cr_2(SiO_4)_3$ | 21 |

Chromite, technically $(Mg,Fe^{+2})(Cr,Al,Fe^{+3})_2O_4$, has served historically as the main source of chromium, and is capable of being directly reduced using the method of the present invention for chromium or chromium alloy production. Similarly, other chromium ores listed in the above Table, or modifications of them to change their cation content, can be reduced by the present invention because they each contain oxygen or sulfur atoms. Each can be used in this invention to produce very-low carbon chromium, ferrochromium, or many low-carbon chromium alloys.

Example 2

Figure 3:
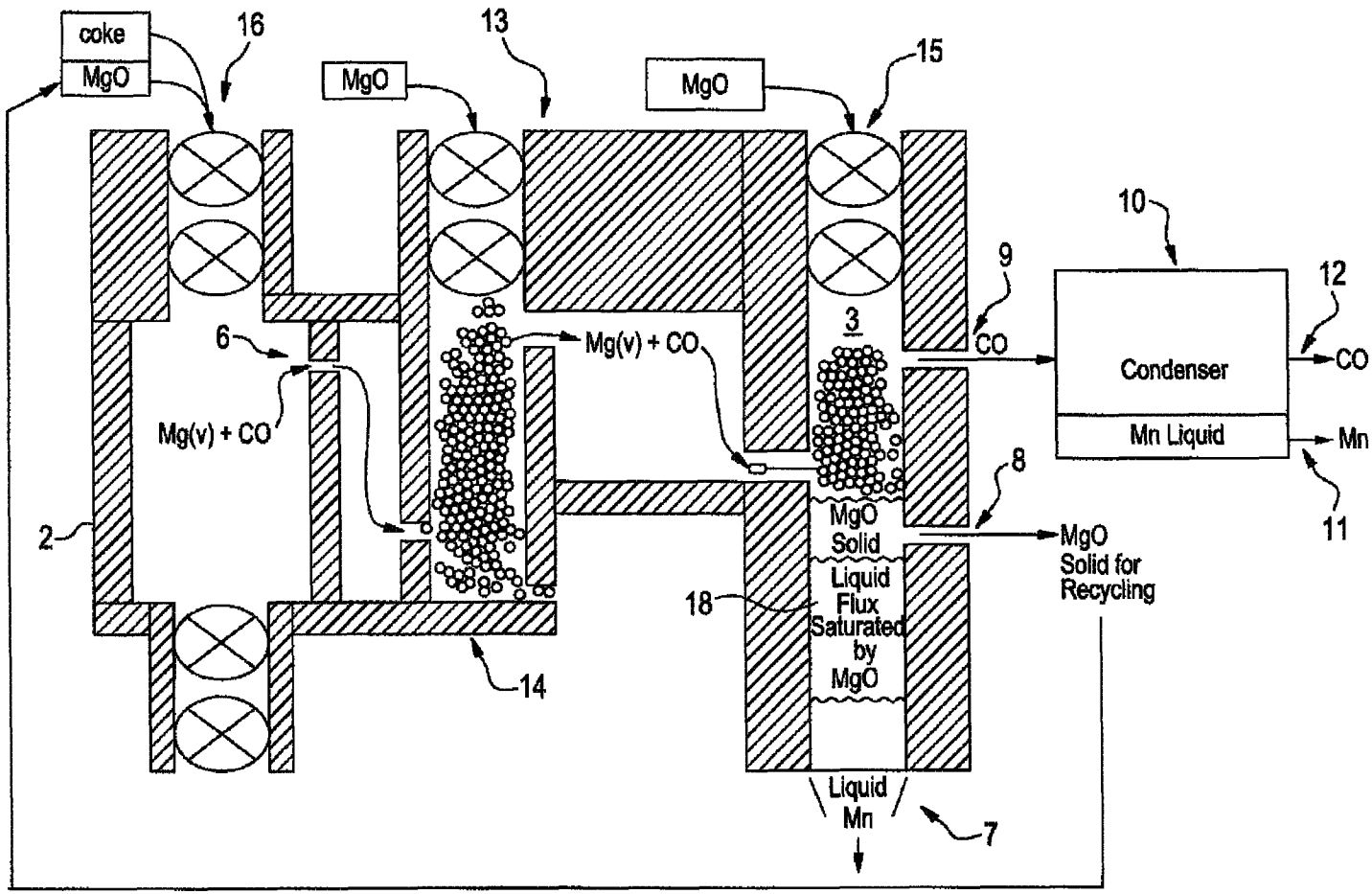
FIG. 3 is a schematic diagram illustrating a continuous embodiment of the present invention producing manganese metal.

The method of the present invention can also be used in the production of very-low carbon manganese using the batch process of FIG. 1 or a continuous reactor 13 as shown in FIG. 3. As before, gaseous Mg/CO mixture is produced by carbothermic reduction of MgO in first chamber 2, $$MgO(c)+C(c) \text{ at } 2200^\circ \text{ K yields } Mg(g)+CO(g)$$

The resulting gaseous Mg/CO mixture is filtered to remove free C, is passed through a MgO fed filter 14 into second reaction chamber 3 to react with MnO (the resulting oxide from heating $Mn_3O_4$) supplied by feed mechanism 15 into second chamber 3 at 2200° K $$Mg(g)+CO(g)+MnO(c \text{ or } l) \text{ at } 2200^\circ \text{ K yields } MgO(c)+Mn(l \text{ or } g)+CO(g)$$

The Gibbs Free Energy values are

0+−303 KJ/mol+−213 KJ/mol - - - - - - - - - - yields −280 KJ/mol+0+−303 KJ/mol

Or, by viewing the gaseous CO as an inert gas at 2200° K

−213 KJ/mol - - - - - - - - - - - yields −280 KJ/mol

The MnO at 2200° K is just below the boiling point of Mn. Mn(g) at 2200° K has a Gibbs Free Energy of +13 KJ/mol. In the batch process some of the Mn as liquid can be tapped out at the bottom of second chamber 3 and existing Mn vapors mixed with CO gas can be drawn off and cooled to about 1800° K, where the Mn is distilled away from the CO gas. The CO gas can then be vented. At 1800° K, the Gibbs Free Energies of the carbon monoxide gas and manganese oxide are; CO(g) is −269 KJ/mol, MnO(s) is −248 KJ/mol. So the CO can be vented away from the liquid Mn at this temperature without back-reaction to MnO and C. The MgO would be recycled. In the continuous process of FIG. 3, gaseous Mn and CO are directed to condenser 10 for separation to liquid Mn 11 and gaseous CO 12, while magnesium oxide is directed to flux chamber 18 for separation of any adherent manganese which is recovered as liquid at 7 while the solid magnesium oxide is recovered at 8 and directed to feed mechanism 16 for reuse in the carbothermic process in first chamber 2. A MgO saturated liquid flux 18 may be employed to separate the solid MgO from the heavy Mn liquid.

In addition, the method of the present invention can be used to reduce manganese and iron mixed oxides yielding very-low carbon ferromanganese, a useful alloy, often used in the steel industry.

The method of the present invention can be used with any of the raw manganese compound sources to produce very-low carbon manganese or alloys if they have oxygen or sulfur atoms. The following table shows several of the ores with manganese atoms.

TABLE 2

| Common Manganese Minerals | | | |
|---|---|---|---|
| Mineral | CAS Registry number | Composition | Mn, % |
| bementite | [66733-93-5] | $Mn_8Si_6O_{15}(OH)_{10}$ | 43.2 |
| braunite | | $Mn_2Mn_6SiO_{12}$ | 66.6 |
| cryptomelane | [12260-01-4] | $KMn_8O_{16}$ | 59.6 |
| franklinite | | $(Fe,Zn,Mn)\dot{O}(Fe,Mn)_2O_3$ | 10-20 |
| hausmannite | [1309-55-3] | $Mn_3O_4$ | 72.0 |
| manganite | [52019-58-6] | $Mn_2O_3H_2O$ | 62.5 |
| manganoan calcite | | $(Ca,Mn)CO_3$ | 35.4 |
| romanechite | | $BaMnMn_8O_{16}(OH)_4$ | 51.7 |
| pyrolusite | [14854-26-3] | $MnO_2$ | 63.2 |
| rhodochrosite | [598-62-9] | $MnCO_3$ | 47.8 |
| rhodonite | [14567-57-8] | $MnSiO_3$ | 41.9 |
| wad | | hydrous mixture of oxides | variable |

These ores can be used directly or after modification to adjust the other cations present to produce the desired atom ratio in the alloy product.

Example 3

The method of the present invention can further be used to produce zinc and zinc alloys. In the process of this invention, the carbothermic magnesium products around 2200° K are again used.

$$MgO(c)+CO(c) \text{ at } 2200° \text{ K yields } Mg(g)+CO(g)$$

The gaseous Mg/CO mixture is passed over ZnS so that $$Mg(g)+CO(g)+ZnS(l) \text{ at } 2200° \text{ K yields } MgS(c)+CO+Zn(g)$$

The Zn is condensed from the CO quickly to prevent a back-reaction between the Zn and CO, or, as employed in the Imperial Smelting Furnace method, condensed into a spray of molten lead and distilled out later.

The MgS can be roasted or treated with an oxygen compound such as steam to convert the Mg entity back to MgO. If steam is used, $$MgS(c)+H2O(g) \text{ at } 1800° \text{ K yields } MgO+H_2S(g)$$

with Gibbs Free Energy of:

−194 KJ/mol+−147 KJ/mol - - yields −361 KJ/mol+−1 KJ/mol

The $H_2S$ can then be subjected to the Claus Process, currently the main process used to generate elemental sulfur from $H_2S$ found in natural gas, $2H_2S(g)+O_2(g)$ to yield 2 $S_2$+2 $H_2O$. The MgO is again recycled.

Figure 4:
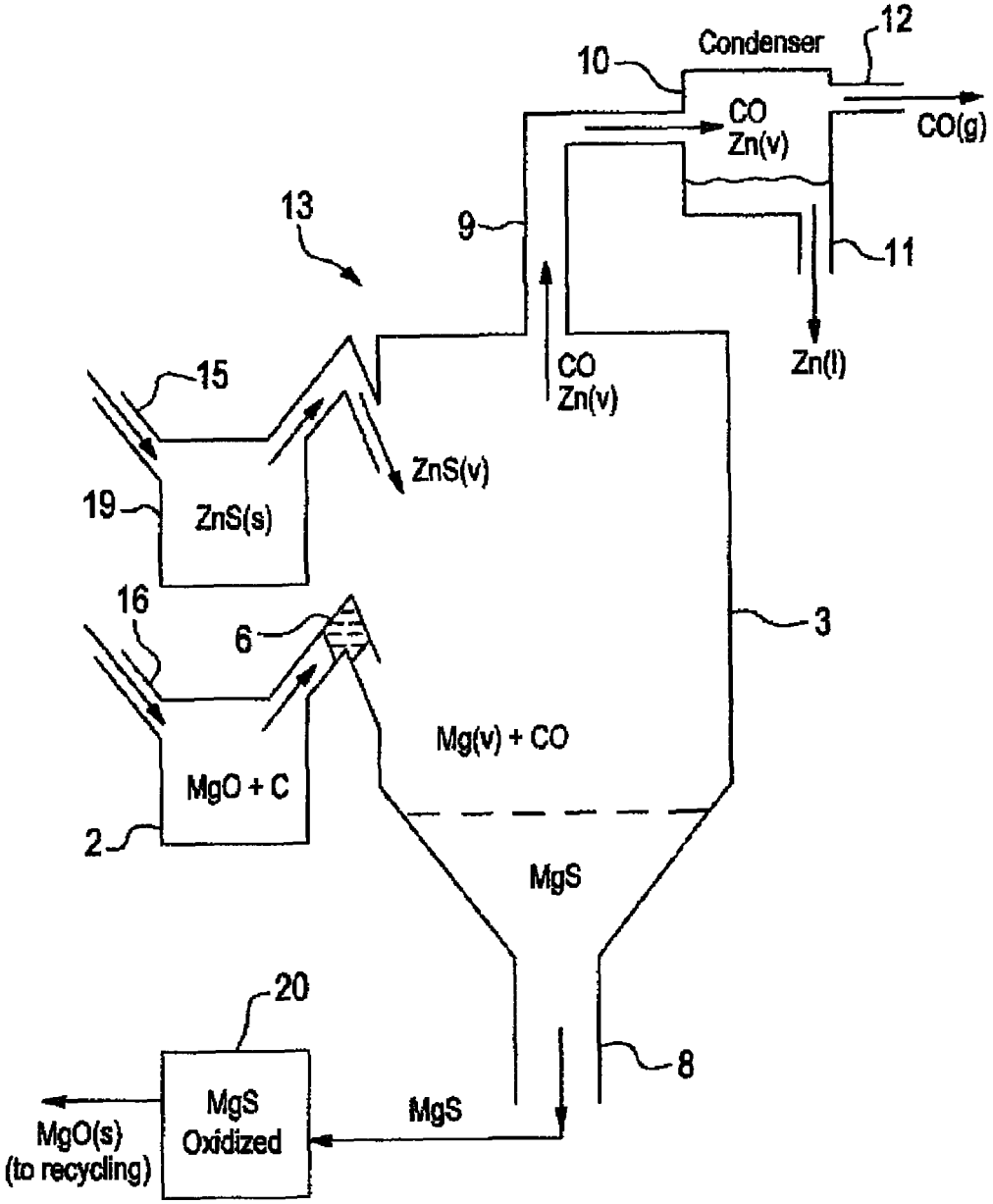
FIG. 4 is a schematic diagram illustrating a continuous embodiment of the present invention producing zinc metal from zinc sulfide vapor.

The batch process of FIG. 1 or the continuous processes of FIGS. 2 and 3 may be used with zinc compounds. FIG. 4 illustrates a further continuous process for production of zinc from zinc sulfide wherein reactor 13 includes a separate preheating chamber 19 to which ZnS is supplied as pellets or particles by feed mechanism 15 and is heated to reaction temperature, preferably 2200° K, generating ZnS vapor which is then supplied to second chamber 3 for reaction with the Mg/CO mixture from first chamber 2. The magnesium vapor reduces zinc sulfide to zinc vapor and magnesium sulfide. The zinc vapor is directed to condenser 10 with the gaseous carbon monoxide while solid magnesium sulfide is collected from the bottom 8 of second chamber 3 and oxidized to magnesium oxide and, ultimately, sulfur. The magnesium oxide is recycled to first chamber 2 by feed mechanism 16 and sulfur is collected from oxidizer 20.

Figure 5:
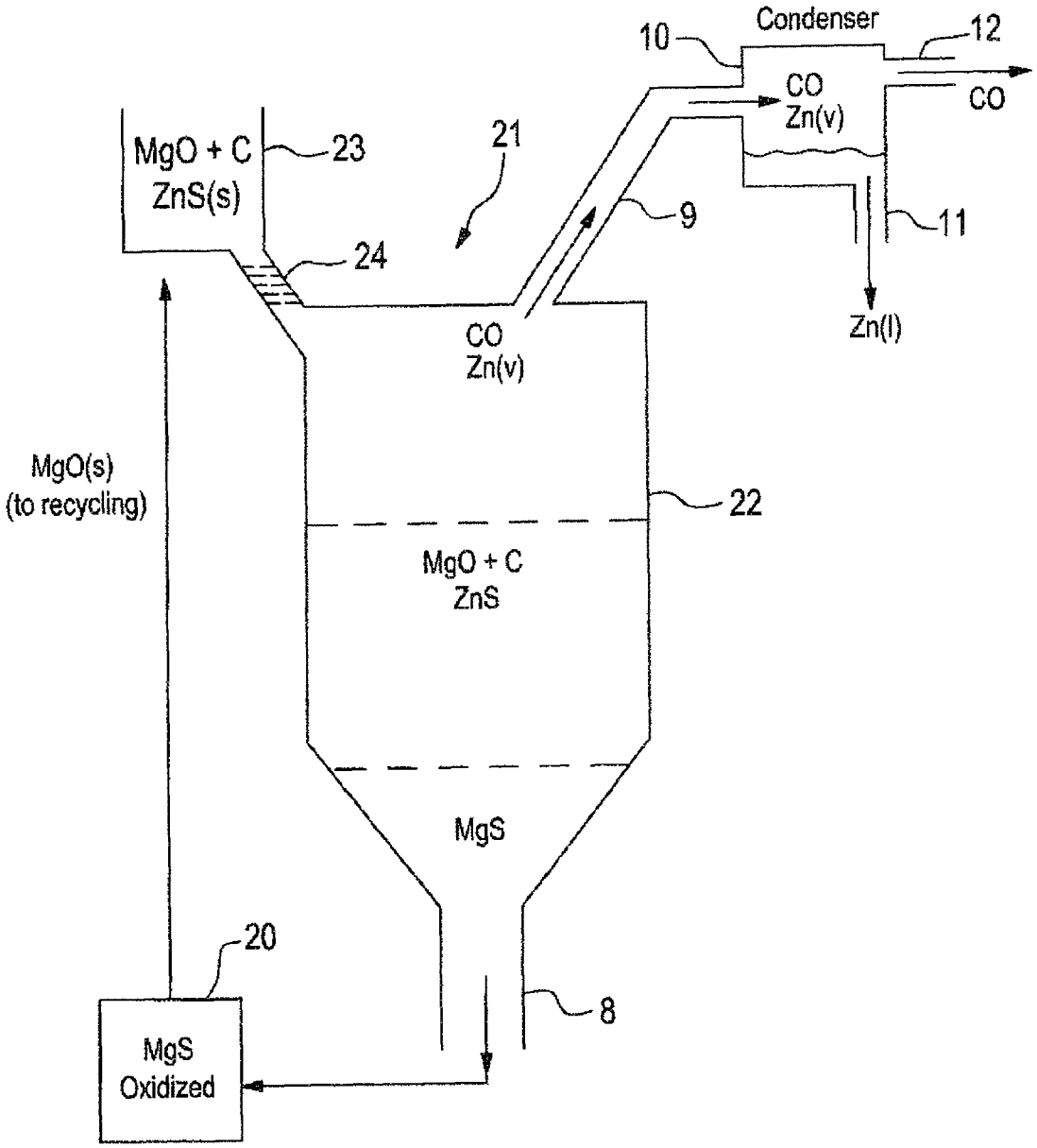
FIG. 5 is a schematic diagram illustrating a continuous embodiment of the present invention in a single chamber apparatus.

The present process can also be applied to the production of zinc from zinc sulfide in a single chamber reaction apparatus 21 as illustrated in FIG. 5. In this modified process, solid particulate, pelletized or powdered zinc sulfide, magnesium oxide and carbon are supplied to reaction chamber 22 from supply 23 by feed mechanism 24. Reaction chamber 22 is maintained at the carbothermic reaction temperature of 2200° K. At that temperature, zinc sulfide vaporizes concurrently with the carbothermic reaction of MgO and carbon to produce magnesium vapor and carbon monoxide. Carbothermic reduction of magnesium oxide and reduction of ZnS by Mg occur substantially simultaneously with the gaseous zinc and carbon monoxide being drawn off from reaction chamber 22 at 9 to condenser 10 for separation as before. Meanwhile, solid magnesium sulfide is recovered at 8 and oxidized to magnesium oxide and sulfur in oxidizer 20. As before, the magnesium oxide is recycled to supply 23 and sulfur is recovered from oxidizer 20. Furthermore, the reactants, ZnS, MgO and carbon may be preheated while in supply 23 and/or feed mechanism by heat recovered from condenser 10.

The sources of zinc listed in Table 3, can also be reduced using the method of the present invention producing zinc either in purified form or as an alloy when mixed with other cation compounds.

TABLE 3

Common Zinc Minerals

| Name | Composition | % Zn |
|---|---|---|
| sphalerite[a] | ZnS | 67.0 |
| hemimorphite[b] | $Zn_4Si_2O_7(OH)_2 \cdot H_2O$ | 54.2 |
| smithsonite | $ZnCO_3$ | 52.0 |
| hydrozincite | $Zn_5(OH)_6(CO_3)_2$ | 56.0 |
| zincite | ZnO | 80.3 |
| willemite | $Zn_2SiO_4$ | 58.5 |
| franklinite | $(Zn,Fe,Mn)(Fe,Mn)_2O_4$ | 15-20 |

[a]Zinc blend, wurtzite.
[b]Calamine.

For example if ZnO is used in second chamber 3, the Mg/CO gas mixture will reduce the ZnO to yield MgO solid, Zn gas, and CO gas. The MgO can be recycled and the Zn and CO gases separated.

A desired alloy of zinc can be made by reducing an ore including the cation or by mixing the alloying metal oxide or sulfide with the zinc starting compound and co-reducing them in second chamber.

Figure 6:
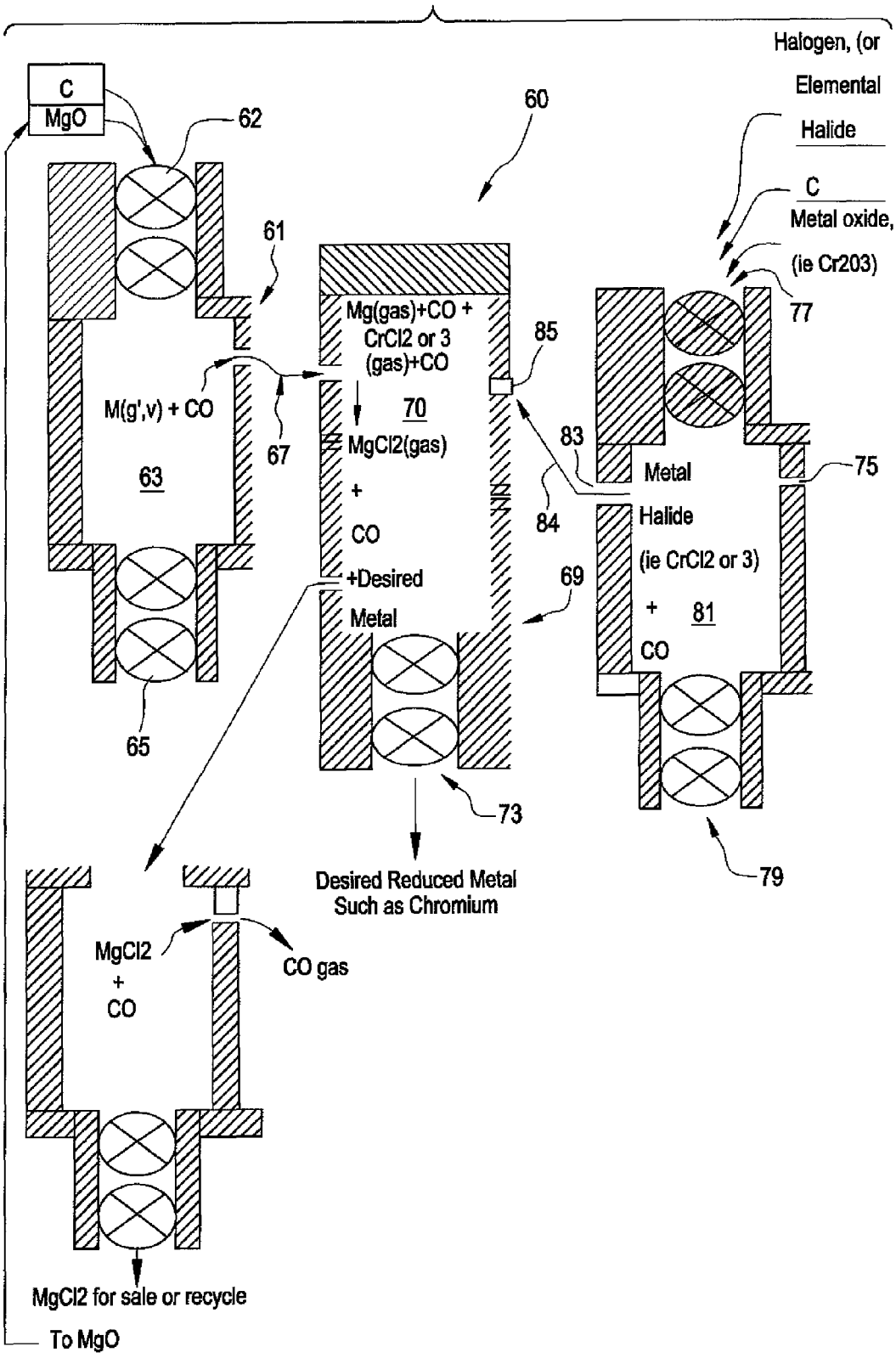
FIG. 6 shows a schematic representation of a further embodiment used to process metal halides to extract the metal.

With reference to FIG. 6, a system is schematically shown which can conduct a process permitting extraction of metal from a metal halide. A list of metal halides may be found at the following link and is incorporated by reference herein: http://en.wikipedia.org/wiki/Category:Metal_halides. In FIG. 6, the system is generally referred to by reference numeral 60 and includes a first housing 61 with a chamber 63 supplied with carbon and MgO in solid form 62, 65. The chamber 63 is heated to a temperature of 1500-2400 degrees K, preferably 2200 degrees K to cause a reaction resulting in formation of Magnesium vapor and CO (carbon monoxide) gas.

The Mg vapor and CO gas are sent to chamber 70 in housing 69 via conduit 67 which may also include a filter. The chamber 70 is maintained at 1500-2400 degrees K to prevent the Mg vapor and CO gas from back-reacting back to MgO and carbon. Meanwhile a metal halide such as Chromium Chloride is supplied to chamber 81 of housing 75 in solid form 77, 79. The chamber 81 is heated to 1500-2400 degrees K and the vaporized Chromium Chloride is supplied to the chamber 70 via conduit 84 between chamber 81 outlet 83 and chamber 70 inlet 85.

In the chamber 70, a reaction occurs that results in formation of Magnesium Chloride and pure Chromium. The Chromium exits outlet 73 while the Magnesium Chloride and CO gas exit the outlet 71. The CO gas may be collected including, if desired with use of a condenser and discarded while the Magnesium Chloride may be sold or recycled into MgO for re-use in the system. The process illustrated in FIG. 6 and described above is equally effective in extracting metal from any metal halide as listed at the link set forth above.

While the invention has been described with respect to certain specific embodiments, it will be appreciated that many modifications and changes may be made by those skilled in the art without departing from the spirit of the invention. It is intended, therefore, that all such modifications and changes are within the true spirit and scope of the invention as recited in the following claims.

What is claimed is:

1. A method for reduction of metal oxides, metal halides, metal sulfides, metal hydroxide or other polyatomic metal compounds, including the steps of:

conducting carbothermic reduction of magnesium oxide in the presence of carbon at an elevated temperature of from 1500 to 2600 degrees Kelvin, producing a mixture of magnesium vapor and carbon monoxide gas, passing said mixture of magnesium vapor and carbon monoxide gas through a filter maintained at said elevated temperature, and contacting said metal oxides, metal halides, metal sulfides, metal hydroxide or other polyatomic metal compounds with said mixture at said elevated temperature, preventing said mixture of magnesium vapor and carbon monoxide gas from undergoing back-reaction to magnesium oxide and carbon, whereby said magnesium vapor effects reduction of said metal oxides, metal halides, metal sulfides, metal hydroxide or other polyatomic metal compounds to metallic forms with the production of magnesium oxide where reduction of metal oxides has occurred or magnesium sulfide where reduction of metal sulfides has occurred, and whereby where reduction of metal oxides has occurred, said magnesium oxide is recovered and recycled to said carbothermic reduction.

2. The method of claim 1 wherein said elevated temperature is from 2000 to 2400 degrees Kelvin.

3. The method of claim 1 wherein said elevated temperature is about 2200 degrees Kelvin.

4. The method of claim 1 wherein the metal in said metal oxides, metal halides, metal sulfides, metal hydroxide or other polyatomic metal compounds is selected from the group consisting of chromium, manganese and zinc.

5. The method of claim 4 wherein said metal sulfide is zinc sulfide and is preheated at about 2200 degrees Kelvin generating zinc sulfide vapor and wherein said zinc sulfide vapor is contacted with said mixture of magnesium vapor and carbon monoxide gas, whereby said zinc sulfide is reduced to zinc vapor and said magnesium vapor is concurrently converted to magnesium sulfide, and whereby said magnesium sulfide is recovered and oxidized to magnesium oxide and the produced magnesium oxide is recycled to said carbothermic reduction.

6. A method for production of metals from metal oxides or halides using a carbothermically produced mixture of magnesium vapor and carbon monoxide gas to reduce said metal oxides or halides after passing said mixture of magnesium vapor and carbon monoxide gas through a filter, including the steps of maintaining said metal oxides and said mixture of magnesium vapor and carbon monoxide gas and said filter at carbothermic temperatures in the range of 1800°- 2600° Kelvin during reduction of said metal oxides or halides, producing pure metal and either magnesium oxide or magnesium halide, separating said metal and said magnesium oxide or magnesium halide and recycling said magnesium oxide to carbothermic production of magnesium vapor and carbon monoxide gas, whereby back reaction of magnesium vapor and carbon monoxide gas to magnesium oxide and carbon before reduction of said metal oxides or halides is prevented.

7. The method of claim 6 wherein said carbothermic temperature is from about 2000 to about 2400 degrees Kelvin.

8. The method of claim 6 wherein said carbothermic temperature is at least about 2200 to about 2600 degrees Kelvin.

9. The method of claim 6 wherein said carbon monoxide gas is vented to a preheater.

10. The method of claim 6 further comprising, following reduction of said metal oxides or halides, passing said carbon monoxide gas through a condenser.

11. The method of claim 6 wherein said metal oxides or halides are oxides or halides of a metal selected from the group consisting of oxides or halides of chromium, manganese and zinc.

12. A method for production of metals from metal oxides, metal sulfides, polyatomic metal compounds or metal halides including the steps of, providing a reactor body comprising first and second reaction chambers, a heating means capable of heating said reactor to carbothermic temperatures in the range of 1800°- 2600° Kelvin and maintaining said temperatures, and a filter means separating said first and second chambers, charging said first chamber with a mixture of magnesium oxide and carbon, charging said second chamber with a solid metal oxide, metal sulfide, metal halide or polyatomic metal compounds in powder, particulate, or pellet, gaseous or liquid form, heating said reactor to said carbothermic temperatures, carbothermically reducing said magnesium oxide to magnesium vapor and producing a mixture of magnesium vapor and carbon monoxide, passing said mixture of magnesium vapor and carbon monoxide gas through said filter means into said second chamber, and contacting said metal oxide, metal sulfide, metal halide or polyatomic metal compounds with said mixture of magnesium vapor and carbon monoxide, whereby said metal oxide, metal sulfide, metal halide or polyatomic metal compounds is/are reduced to metallic form and where a metal oxide or metal halide has been reduced, said magnesium vapor is oxidized to magnesium oxide or magnesium halide, respectively.

13. The method of claim 12 further including the step of maintaining said reactor at a temperature sufficient to prevent back-reaction of said magnesium vapor and said carbon monoxide to magnesium oxide and carbon.

14. The method of claim 13 wherein said reactor is heated to and maintained at a temperature of at least about 2200 to about 2600 degrees Kelvin.

15. The method of claim 14 further comprising drawing off said carbon monoxide gas and any fume gases from said second chamber to a condenser.

16. The method of claim 15 further comprising recovering said magnesium oxide, where formed, or halide from said second chamber and recycling said recovered magnesium oxide to said first chamber.

17. The method of claim 16 comprising establishing a said metal oxide or halide in said second chamber wherein said metal oxide or halide is continually supplied to said second chamber by a first feed mechanism and continuously supplying said mixture of magnesium vapor and carbon monoxide to said metal oxide or metal halide at a rate to maintain a reaction in said second chamber and concurrently recovering said metal, carbon monoxide and magnesium oxide or halide and continually recycling said magnesium oxide to said first chamber by a second feed mechanism.

* * * * *